United States Patent [19]

Honkomp et al.

[11] Patent Number: 5,058,197

[45] Date of Patent: Oct. 15, 1991

[54] HEATER APPARATUS FOR FLUID MEDIUM IN A HERMETICALLY SEALED CHAMBER

[75] Inventors: Glenn A. Honkomp, Warren; Thomas O. McNay, Clermont; Larry G. Burrows, Hamilton; James M. Brown, Shelby, all of Ohio; Benjamin Bowsky, St. Louis, Mo.

[73] Assignee: Emerson Electric Co., St. Louis, Mo.

[21] Appl. No.: 503,286

[22] Filed: Apr. 2, 1990

[51] Int. Cl.[5] ..... H05B 3/78; F24H 1/20

[52] U.S. Cl. ..... 392/455; 392/501; 392/502

[58] Field of Search ..... 219/280, 312, 316, 318–319, 219/335–336, 338, 505; 338/22 R; 392/501, 502, 455

[56] References Cited

U.S. PATENT DOCUMENTS

| | | | |
|---|---|---|---|
| 3,835,434 | 9/1974 | Kahn | 338/22 R |
| 4,086,467 | 4/1978 | Grant | 219/505 |
| 4,091,267 | 5/1978 | Grant | 219/505 |
| 4,447,799 | 5/1984 | Carlson | 338/22 R |
| 4,786,762 | 11/1988 | Bowsky et al. | 174/152 GM |
| 4,797,534 | 1/1989 | Prager et al. | 219/326 |
| 4,822,980 | 4/1989 | Carbone et al. | 338/22 R |

FOREIGN PATENT DOCUMENTS

| | | | |
|---|---|---|---|
| 2040523 | 2/1972 | Fed. Rep. of Germany | 219/505 |

*Primary Examiner*—Bruce A. Reynolds
*Assistant Examiner*—John A. Jeffery
*Attorney, Agent, or Firm*—Polster, Polster and Lucchesi

[57] ABSTRACT

A heating apparatus for heating a fluid medium confined in a hermetically sealed housing chamber including a terminal assembly having a body member sealed in the housing chamber wall with pin means extending in sealed relation therethrough to provide electrically conductive inner and outer pin segments respectively connected to a heat transfer member and an electric power source, the inner pin segment means and heating element being electrically insulated from the housing wall.

3 Claims, 1 Drawing Sheet

HEATER APPARATUS FOR FLUID MEDIUM IN A HERMETICALLY SEALED CHAMBER

BACKGROUND OF THE INVENTION

The present invention relates to a heater apparatus for heating fluid medium confined in a hermetically sealed chamber and more particularly to an apparatus which includes a heating element that extends directly into the sealed chamber.

In the refrigerant compressor art, it is generally known to heat the fluid medium confined in a crankcase of a refrigerant compressor by means of a PTC thermistor device confined in a heat conductive ceramic case such as disclosed in U.S. Pat. No. 4,236,065, issued to M. A. Yashin et al. on Nov. 25, 1980 and U.S. Pat. No. 4,644,316 issued to M. Takeuchi et al. on Feb. 17, 1987. An appropriately sized, heat conductive metallic sleeve member which is closed at one end and open at the other, has its opened end sealed to the wall of the crankcase with its closed end projecting into the crankcase chamber. A ceramic encased PTC heater is inserted into the sleeve opening and connected to an electrical source to heat fluid medium in the crankcase chamber through the surrounding heat conductive metallic sleeve member projecting into the crankcase.

The present invention recognizing that such past apparatus presents problems in heat loss through the encasing heat conductive metallic sleeve and the housing to which it is attached and that the wattage required to apply the required heat is not directly responsive to the fluid medium confined by the crankcase housing and surrounding ambient conditions, provides a novel crankcase heater arrangement which avoids these past difficulties by eliminating the comparatively costly and difficult to manufacture and assemble heat conductive sleeve and by inserting a heating member electrically connected to a conventionally mounted terminal assembly to heat the fluid medium in a more direct manner without the aforedescribed concomitant heating losses through a heat conductive sleeve and the crankcase housing to which it is mounted. Further, the crankcase heater arrangement of the present invention is more directly responsive to confined fluid medium and ambient temperature conditions so as to minimize wattage consumption and thus optimize overall heating efficiency. In addition, the present invention facilitates the ready and selective positioning of the heater unit to minimize past problems of fluid medium slugging and air entrapment between heater and housing.

Various other features of the present invention will become obvious to one skilled in the art upon reading the disclosure set forth herein.

BRIEF SUMMARY OF THE INVENTION

More particularly, the present invention provides a novel heating apparatus to be mounted in a fluid medium containing chamber defined by a wall of a hermetically sealed housing comprising: a terminal assembly including a body member sealed to the housing wall, the body member having terminal pin means embedded in a seal extending between the terminal pin means and an aperture in the body member with an outer pin segment of the terminal pin means extending outwardly from the outer face of the wall to be electrically connected to an electric power source and an inner pin segment of the terminal pin means extending inwardly from the inner face of the wall into the fluid medium chamber; and, a heating element electrically connected to the inner pin segment of the terminal pin means to be disposed in the chamber to transmit heat to the fluid medium. In addition, the present invention provides a unique arrangement of combining and positioning a PTC thermistor disc with the terminal pins of a terminal assembly for heating a fluid medium in a more direct and efficient manner than heater elements of past arrangements. Further, the present invention provides for an insulating sleeve surrounding the inner pin segment extending into the fluid chamber with one end of the sleeve embedded in the seal between the pin and body member.

It is to be understood that various changes can be made in one or more of the several parts of the apparatus disclosed herein without departing from the scope or spirit of the present invention. For example, other types and configurations of PTC thermistor heating units beside that disclosed can be utilized with the internal pin segments of the terminal assembly and the terminal assembly itself can be any one of a number of terminal assemblies known in the art, including those known to include a fuse-like area either on or adjacent to the terminal pin means.

BRIEF DESCRIPTION OF THE DRAWINGS

Referring to the drawing which discloses one advantageous embodiment of the present invention.

DETAILED DESCRIPTION OF THE DRAWING

Figure 1:
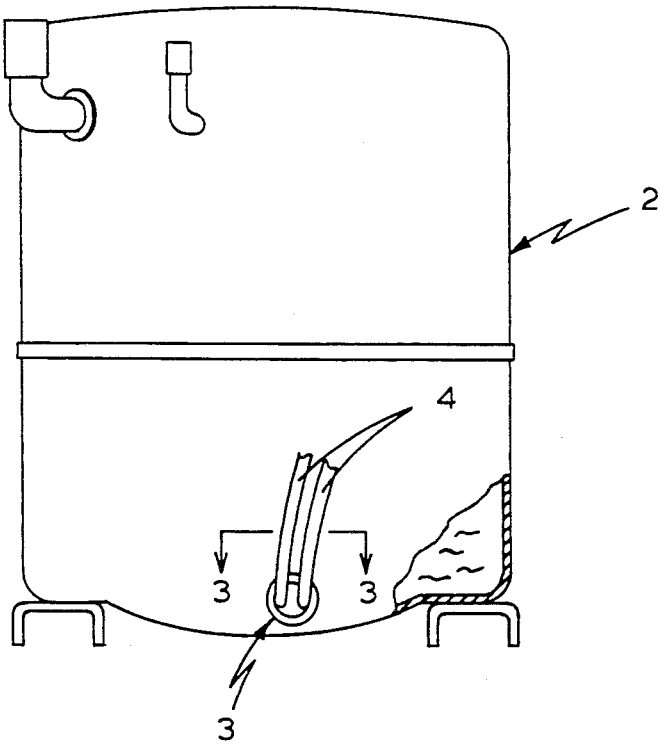
FIG. 1 is a side view of a hermetically sealed heater housing assembly in the general form of a refrigeration compressor crankcase heater which heater incorporates the novel terminal assembly heater of the present invention.

Referring to FIG. 1 of the drawing a hermetically sealed crankcase housing 2 of a configuration generally known in the refrigeration art is disclosed incorporating the novel heater apparatus 3 located directly within the hermetically sealed housing and advantageously at the bottom of housing 2. Suitable electrical wires 4, leading from an electrical power source (not shown) are provided to connect to the outer pin segments of heater disclosed in detail in FIG. 2 of the drawing.

Figure 2:
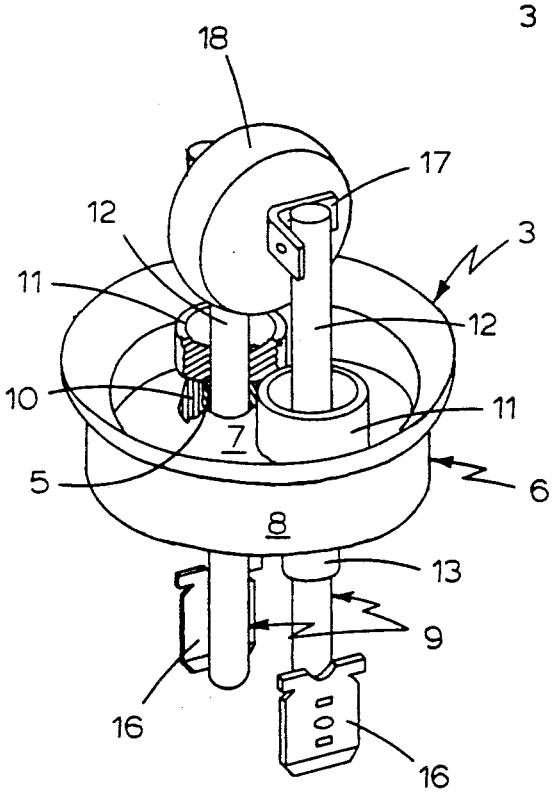
FIG. 2 is an enlarged, partially broken away isometric view of the novel terminal assembly heater arrangement incorporated in the heater housing of FIG. 1.
Figure 3:
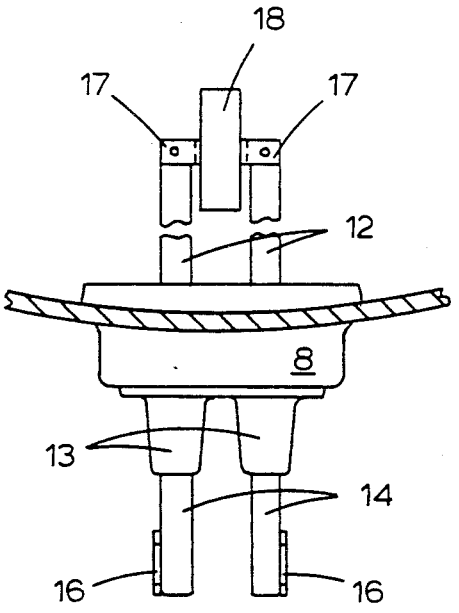
FIG. 3 is an enlarged, partially broken view of the terminal assembly heater and housing assembly taken in a plane through line 3—3 of FIG. 1.

As can be seen in FIG. 2, the heater apparatus 3 to be mounted in the wall confining electrically non-conductive refrigerating fluid medium in housing 2 is in the form of a terminal assembly including a cup-shaped body member 6 have a bottom or base 7 and a peripheral rim 8. The base 7, as is known in the art of terminal assemblies and therefore not shown in detail herein, is provided with a pair of spaced apertures therein through which a pair of spaced electrically conductive terminal pins 9 extend. As also is known in the art and shown at the broken away portion of FIG. 2, each of pins 9 is embedded in an appropriate seal 5 which is usually of glass and which extends between the outer periphery of the pin and a lip 10 integral with the aperture periphery so that pin 9 is in sealed relation with base or bottom 7. A suitable arc preventing insulating sleeve 11 of ceramic, glass or a composition of both surrounds each inner pin segment 12 with one end of the insulating sleeve 11 being embedded in the sea 5 and the other end of the sleeve being appropriately recessed to minimize the possibilities of arcing between inner pin segment 12 and cup-shaped body member 6. In this regard, an appropriate insulating silicone rubber coating 13 can be provided at the base of each outer pin segment 14 with the extremities of each outer pin segment having an electrical connector 16 fastened thereto to receive one of the lead wire ends of wires 4 (FIG. 1).

Electrically fastened to each extremity of each inner pin segment 12 of terminal pin 9 by some suitable means such as spot welding is one leg of a pair of mirror-image right angle support members 17 (only one of which can be seen in the drawing) the other leg of these support members is so arranged that these opposed legs face each other in spaced relation and serve to receive and conductively support therebetween by some suitable means such as spot welding, the opposite faces of an appropriate PTC thermistor disc 18 with the wider opposed face portions of such heater disc 18 extending in a longitudinal fashion proximate the longitudinally extending center line of the fluid chamber to enhance fluid medium heating capabilities of the heater. The thermistor disc 18 can be formed from any one of a number known PTC thermistor discs which are formed from elements similar to those described in the aforementioned U.S. Pat. Nos. 4,236,065 and 4,644,316.

Although, in accordance with the present invention, it is possible to locate the heating element at any one of a number of suitable locations within hermetically sealed housing 2, it has been recognized to be advantageous that the heating element, in the form of the PTC thermistor disc 18, which can covered with a suitable insulating material, such as epoxy coating, be located as shown in the lower portion of housing 2 to be more responsive to the electrically non-conductive fluid medium temperature and the surrounding ambient conditions, to optimize the power requirements as existing occasions require.

The invention claimed is:

1. A heating apparatus for a confined chamber comprising: a refrigerating fluid medium containing chamber defined by outer walls of a hermetically sealed compressor housing, one of said walls having an aperture in the lower portion thereof; and, a unitary heating assembly including a cup-shaped body member having a base and a perpendicular rim extending therefrom, said rim extending through and being sealed directly to said aperture in the lower portion of said outer wall of said compressor housing, said base of said cupshaped body member in turn having a pair of spaced apertures therein to accommodate a pair of spaced terminal pins each embedded in a seal extending between said terminal pin and one of said spaced apertures in said base of said body member in sealed relation therewith to provide a pair of spaced inner pin segments to be connected to a heating element and a pair of spaced outer pin segments to be connected to an electrical power source with each of said inner pin segments extending into direct contact with the fluid medium of said fluid chamber and being surrounded by an insulating sleeve with one end of said sleeve embedded in one of said aperture seals, said unitary assembly having a heating element comprising an electrically conductive PTC thermistor disc electrically and supportively connected across said inner pin segments to extend into the lower portion of said chamber and directly into said refrigerating fluid medium in heat transfer relation therewith.

2. The heating apparatus of claim 1, said PTC thermistor disc being treated with an epoxy coating material with the opposite faces thereof bonded to a pair of electrically conductive support members each in turn being bonded to an inner pin segment.

3. The heating apparatus of claim 1, wherein said disc faces are wider than the thickness of said disc with the wider faces extending longitudinally proximate the longitudinal center line of said fluid medium containing chamber.

* * * * *

UNITED STATES PATENT AND TRADEMARK OFFICE

CERTIFICATE OF CORRECTION

PATENT NO. : 5,058,197

DATED : Oct. 15, 1991

INVENTOR(S) : Glenn A. Honkomp et al

It is certified that error appears in the above—identified patent and that said Letters Patent is hereby corrected as shown below:

Claims

Claim 1, column 4, line 7, delete "perpendicular" and insert -- peripheral --.

Signed and Sealed this

Twenty-third Day of February, 1993

*Attest:*

STEPHEN G. KUNIN

*Attesting Officer*

*Acting Commissioner of Patents and Trademarks*